United States Patent [19]

Oliver, Jr.

[11] 4,410,136

[45] Oct. 18, 1983

[54] FURNACE ECONOMIZER-HUMIDIFIER

[76] Inventor: C. F. Oliver, Jr., 118 Siguenza Dr., Pensacola, Fla. 32561

[21] Appl. No.: 109,181

[22] Filed: Feb. 12, 1980

[51] Int. Cl.[3] ..... F24B 7/00

[52] U.S. Cl. ..... 237/55; 126/113; 165/DIG. 2

[58] Field of Search ..... 237/55, 78, 54; 165/DIG. 2, 134 DP; 126/101 R, 113

[56] References Cited

U.S. PATENT DOCUMENTS

| | | | |
|---|---|---|---|
| 1,314,824 | 9/1919 | McLachlan | 237/55 |
| 1,573,406 | 2/1926 | Lewis | 237/55 |
| 1,839,618 | 1/1932 | Toepfer | 261/156 |
| 2,343,542 | 3/1944 | Faunce | 237/55 X |
| 2,354,773 | 8/1944 | Ray | 126/113 |
| 2,480,596 | 8/1949 | Muller | 237/55 |
| 2,634,720 | 4/1953 | Thulman | 237/55 |
| 2,683,590 | 7/1954 | Baver | 165/134 DP |
| 4,176,652 | 12/1979 | Berg | 126/121 |
| 4,227,647 | 10/1980 | Eriksson | 122/20 B |
| 4,241,874 | 12/1980 | Schossow | 237/55 |

*Primary Examiner*—Albert J. Makay
*Assistant Examiner*—Henry Bennett

[57] ABSTRACT

The present invention provides apparatus for utilizing heat in the flue of the furnace as a heat exchanger and a humidifying source which comprises a flue with a conduit spaced from and concentric with the flue. Means are provided for forcing air from the upper part of the conduit downwardly between the flue and the conduit in a direction opposite to the normal flow of the gases in the flue. Further means are providing for applying moisture to the outer surface of the upper part of the flue within the conduit and above the means for forcing air into the conduit. The heated and humidified air passes downwardly in the conduit and outwardly therefrom and may be connected to the plenum of the furnace. Baffles may be supplied within the flue and within the conduit in order to increase the turbulence of the air and thus increase the heat exchanger which is provided by the system.

7 Claims, 8 Drawing Figures

FURNACE ECONOMIZER-HUMIDIFIER

This application relates generally to a furnace economizer and more specifically to a furnace economizer and humidifier which utilizes sensible and latent heat from the furnace flue gases.

BACKGROUND OF THE INVENTION

Many systems have been proposed which are designed so as to attempt to capture the heat that passes through the flue, and recirculate it or reuse it within the furnace in order to improve upon the efficiency of the furnace. In most cases, these systems use a pipe which surrounds and is concentric with the flue. A blower is usually connected to the upper part of the pipe so as to force the air downwardly between the pipe and the flue, thus picking up heat from the flue as the gases in the flue pass upwardly. In the usual system, this heated air is passed back into the plenum chamber and used as preheated air in the furnace. One such standard type system is shown in U.S. Pat. No. 2,361,643 issued Oct. 31, 1944.

Humidification is also quite commonly used during the winter time. Such humidification is usually achieved either by the use of a spray or a membrane within the area immediately adjacent to the plenum chamber which provides the main hot air outlet from the furnace. Such humidification does not take advantage of any particular heat transfer, and, therefore, supplies only humidity to the air without improving the heat exchanger characteristic and, thus, the efficiency of the furnace. efficiency of the furnace.

Accordingly, it is an object of the present invention to provide a system which utilizes sensible and latent heat of the furnace flue gas to provide increased efficiency in the heating of the home and, additionally, provides the desired humidification.

A further object of the present invention is to provide an economizer system which provides increased efficiency and humidification and which may be easily adapted to existing furnaces.

These and other objects of the invention will become apparent from the following descriptions taken together from the accompanying drawings.

SUMMARY OF THE INVENTION

The present invention provides apparatus for utilizing heat in the flue of the furnace as a heat exchanger and a humidifying source which comprises a flue with a conduit spaced from and concentric with the flue. Means are provided for forcing air from the upper part of the conduit downwardly between the flue and the conduit in a direction opposite to the normal flow of the gases in the flue. Further means are provided for applying moisture to the outer surface of the upper part of the flue within the conduit and above the means for forcing air into the conduit. The heated and humidified air passes downwardly in the conduit and outwardly therefrom and may be connected to the plenum of the furnace.

Baffles may be supplied within the flue and within the conduit in order to increase the turbulence of the air and, thus, increase the heat exchanger which is provided by the system.

DETAILED DESCRIPTION OF A PREFERRED EMBODIMENT OF THE INVENTION

Figure 1:
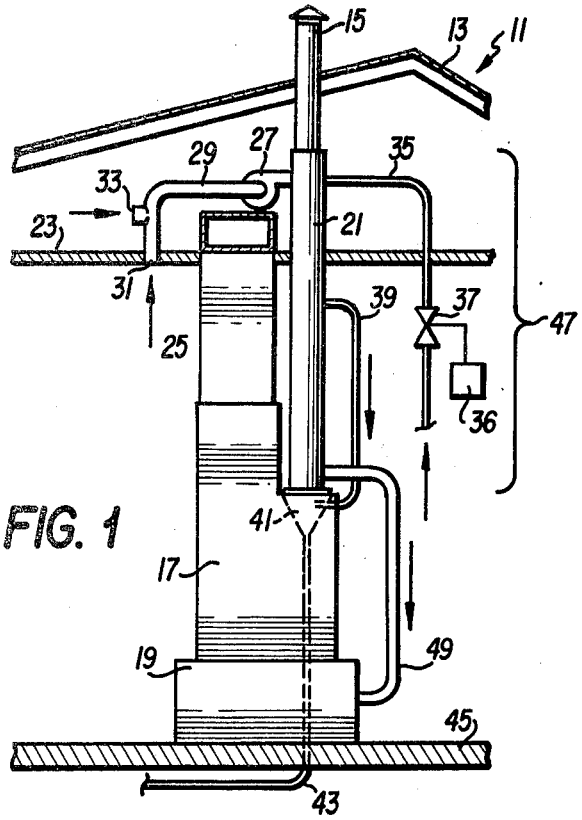
FIG. 1 is a schematic showing of the economizer system of the present invention in use in a home.

Turning now to the drawings, there is shown in FIG. 1 a house 11 having a roof 13 and a vent stack 15 passing through the roof from the furnace. A furnace 17 includes a plenum chamber 19 and a flue stack 22 (FIG. 2) with a conduit 21 surrounding the flue stack and substantially concentric therewith.

Ceiling 23 is generally indicated and is shown as having an air supply duct 25 extending upwardly therethrough which leads to the various rooms of the house in a normal fashion. In the configuration shown in the drawings, a blower fan 27 is located in the attic and is connected to conduit 29 which is fed from a residence inlet 31 and from attic inlet 33. The details of this system will be more clearly understood in the discussion relative to FIG. 2. Also shown is a water supply line 35 having a valve 37 controlled by a humidistat 36. A condensate reservoir 41 is shown at the bottom of the flue pipe and is connected to an exterior drain 43. Such a drain would normally extend down through the floor 45 so as to be drained outside of the house itself.

Figure 2:
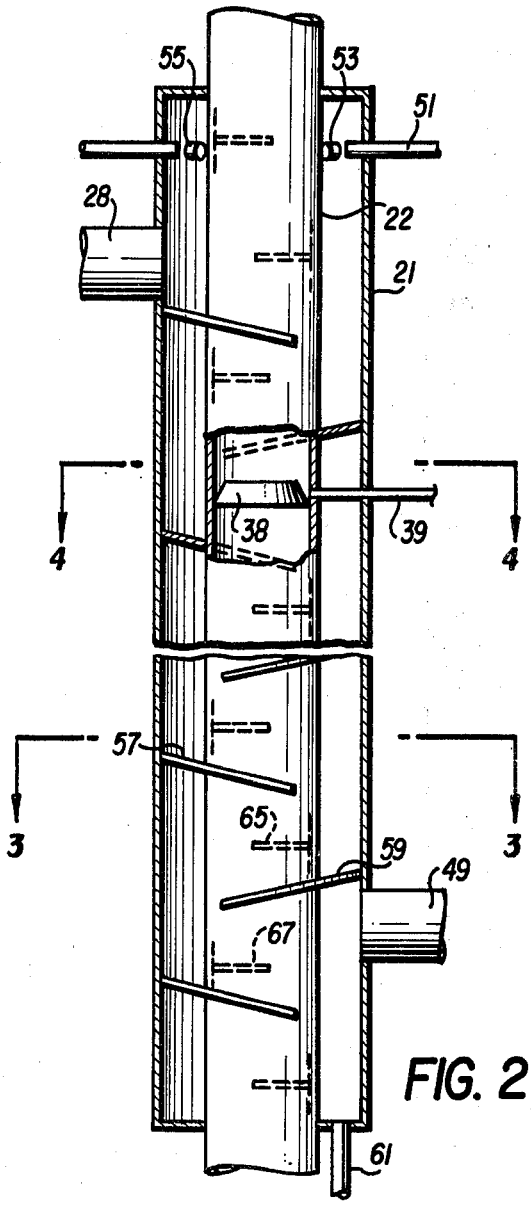
FIG. 2 is a partial sectional view of the basic economizer system shown in FIG. 1.
Figure 3:
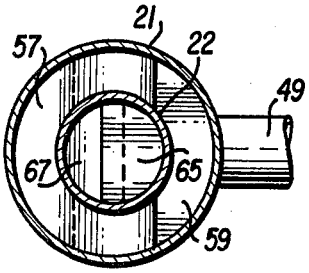
FIG. 3 is a sectional view taken along the lines 3—3 of FIG. 2.
Figure 4:
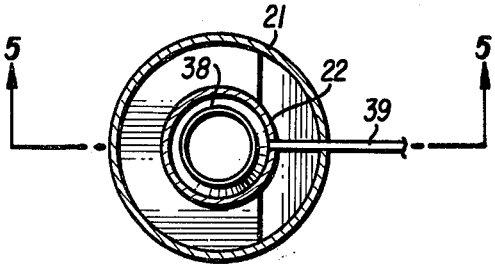
FIG. 4 is a sectional view taken along the lines 4—4 of FIG. 2.

Turning now to FIGS. 2, 3, and 4, the basic economizer system as indicated at 47 in FIG. 1 is shown in detail. The air from blower 27 is provided through conduit 28 into the interior of the conduit 21 and is forced downwardly and exits through the conduit 49 at the lower part of the economizer. Located within the upper part of conduit 21 are a plurality of water sprays 51, 53, and 55 which are directed so as to spray water against the exterior of flue pipe 22. Also located within conduit 21 are a series of baffles, two of which are indicated at 57 and 59. The baffle structure can be more clearly seen in FIG. 3 wherein each baffle is substantially semicircular and surrounds a portion of flue pipe 22. The baffles are alternately spaced in opposition to each other along the length of the flue pipe. The purpose of these baffles is to create turbulence of the air being forced in by blower 27 so as to have the maximum possible heat exchange between such air and the air rising in the flue pipe 22. The water which is sprayed onto the outer surface of flue pipe 22 creates a heat transfer as it evaporates into the air stream, and additionally provides the humidity which is normally required. Any condensate which remains after the air passes downwardly through the baffles may be removed by means of a condensate line 61. Such water may be reused if desired by pumping it back to the water supply line 35. Details of such a system are not shown.

The interior of the flue is also provided with baffles such as baffle 65 and 67. These baffles, as more clearly shown in FIG. 3, are substantially semicircular and fit against the inner surfaces of flue pipe 22 and are alternately arranged in opposition to each other along the flue. This creates turbulence of the flue gases to assist in the maximum heat exchange between the heat in the flue and the air passing in the conduit 21.

The water which is sprayed or applied to the upper part of flue pipe 22 causes a condensation of the moisture in the flues gases within the flue pipe. This condensation is collected by means of a condensation reservoir 38 which comprises a frustro-conical shield with its outer dimension butting against the inner surface of flue pipe 22. This creates a reservoir pocket which may be drained by means of a drain line 39. Drain line 39 is also connected to the drain funnel 41 as indicated more clearly in FIGS. 4 and 5.

Figure 5:
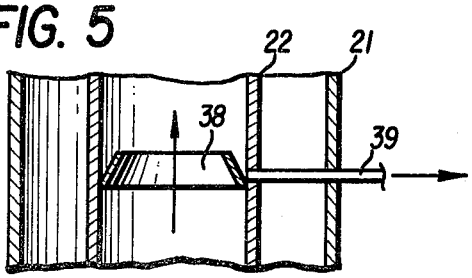
FIG. 5 is a sectional view taken along the lines 5—5 of FIG. 4.
Figure 6:
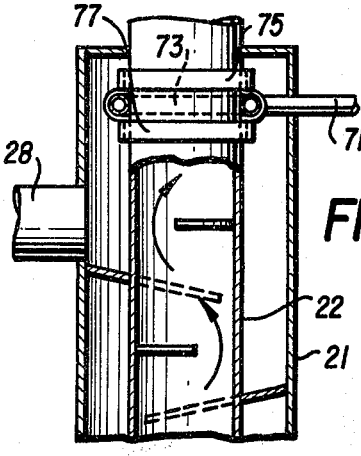
FIG. 6 is a partial sectional view of a modification of the economizer system of FIG. 2.

FIG. 5 is a partial sectional view of a modification of the water application apparatus shown in FIG. 2. In this construction, the inlet water conduit is connected to a distributing pipe 73. This distributing pipe has small orifices therein and wets fabric 75 which is held tightly against pipe 22 by means of band clamps 77 or the like. It should be noted that the application of water is preferably controlled by humidistat 36. In both cases, the humidistat is connected to the furnace controls to assure that it only allows water to pass through valve 37 when the burner of the furnace is on.

In order to avoid corrosion from the water or the oxidation thereof, it is preferable that the economizer system use some non-corrosive metal such as stainless steel.

Figure 7:
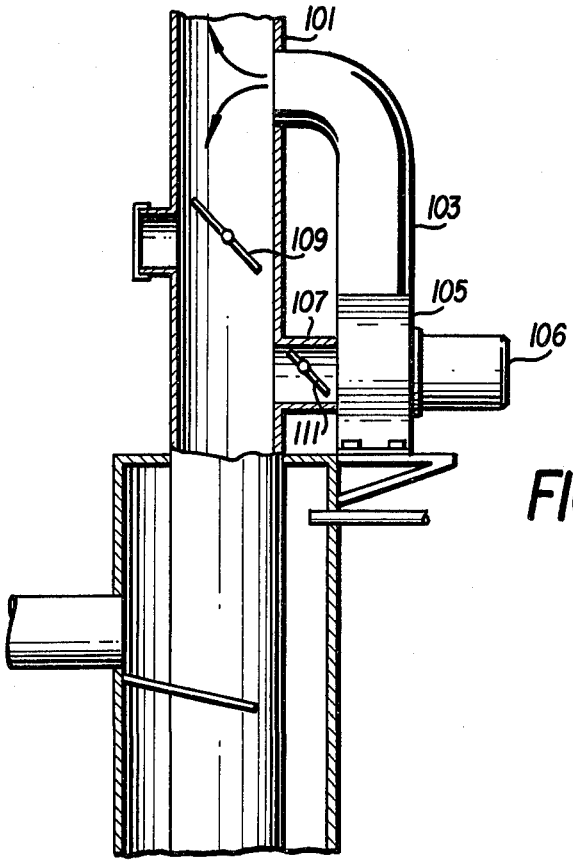
FIG. 7 is a partial sectional view of a modification of the invention showing a recycling regulator.
Figure 8:
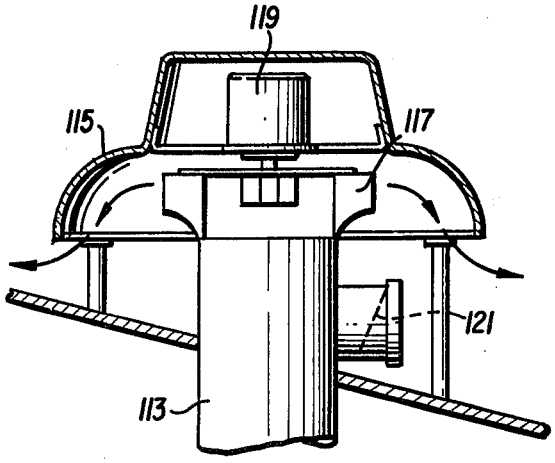
FIG. 8 is a partial sectional view of a further modification of the invention showing a roof fan for providing an induced draft.

When the flue gases are cooled below 200° F. by the humidification and cooling described above, induce draft will be needed to supplement the natural draft within the system. FIGS. 7 and 8 disclose two means for inducing such draft.

There is shown in FIG. 7 a conduit 103 which is connected to the flue 101 and effectively provides the bypass by means of a connecting conduit 107 providing an inlet fan 105 which is driven by means such as a motor 106. Two regulators are provided by means of dampers 109 and 111 which effectively control the amount of induced draft which is provided by the system shown in FIG. 7. These damper-regulators are adjustable by being hand positionable and are set during the initial installation. No further adjusting is required since draft conditions or any one particular installation will remain constant.

Another means of providing the induced draft is shown in FIG. 8 wherein the flue 113 has mounted above it a hood 115 with a fan 117 being placed directly above the terminal end of flue 113. Again, the fan may be driven by means such as a motor 119. Draft regulation may also be provided here by use of an adjustable damper 121 which will also be set for initial operation and should require no further adjustments.

As can be seen from the above description, the present invention provides utilization of wetted surfaces to improve heat transfer and humidity through a simplified system which is adaptable to practically every hot air furnace. The basic ease of installation and the great improvement in furnace efficiency provides an installation which will pay for itself in a short period of time.

It should be understood that the above description and drawings are descriptive only since various equivalent elements could be substituted without departing from the inventive concept. Accordingly, the invention is to be limited only by the scope of the following claims.

I claim:

1. Apparatus for utilizing heat in the flue of a furnace as a heat exchanger and humidifying source for a building comprising a substantially vertical flue;

a first conduit means spaced from and substantially concentric with said flue and substantially coextending with said flue;

at least one air supply duct connected to the interior of said building;

a second conduit means connecting said supply duct to said first conduit means;

blower means in said second conduit means for forcing air between said flue and said first conduit means substantially the length of said first conduit means in a direction opposite to the normal flow of gases in said flue;

means for applying moisture to the outer surface of said flue within said first conduit means and above the blower means;

air outlet means at the other end of said first conduit means;

condensate drain collecting means secured within said flue substantially above said furnace;

a conduit connected to and bypassing a section of said flue;

a power driven fan in said conduit; and a damper regulator mounted in said flue between the openings of said conduit.

2. The apparatus of claim 1 further comprising a plurality of baffles secured within said flue.

3. The apparatus of claim 1 comprising a plurality of baffles extending between said flue and said first conduit means.

4. The apparatus of claim 1 wherein said condensate drain collecting means within said flue comprises an open frustro-conical shield butting against the inner surface of said flue.

5. The apparatus of claim 1 wherein said means for applying moisture to said flue comprises at lease one water spray device.

6. The apparatus of claim 1 wherein said means for applying moisture to said flue comprises an absorbent material adjacent said flue connected to a water supply.

7. The apparatus of claim 1 wherein said means for inducing said draft comprises an exhaust fan mounted at the upper end of said flue.

* * * * *